US007905043B2

(12) United States Patent
Hopkins

(10) Patent No.: US 7,905,043 B2
(45) Date of Patent: Mar. 15, 2011

(54) BORESIGHT LASER AIMING SYSTEM FOR FIREARMS

(76) Inventor: David K. Hopkins, Valdosta, GA (US)

( * ) Notice: Subject to any disclaimer, the term of this patent is extended or adjusted under 35 U.S.C. 154(b) by 0 days.

(21) Appl. No.: 12/450,485

(22) PCT Filed: Feb. 29, 2008

(86) PCT No.: PCT/US2008/002719

§ 371 (c)(1),
(2), (4) Date: Sep. 28, 2009

(87) PCT Pub. No.: WO2008/121196

PCT Pub. Date: Oct. 9, 2008

(65) Prior Publication Data

US 2010/0011648 A1 Jan. 21, 2010

(51) Int. Cl.
*F41G 1/00* (2006.01)

(52) U.S. Cl. ..... 42/116; 42/114; 42/134; 102/503; 102/430; 102/471

(58) Field of Classification Search ..... 42/116, 42/114, 134; 102/503, 430, 439, 471
See application file for complete search history.

(56) References Cited

U.S. PATENT DOCUMENTS

| | | | | |
|---|---|---|---|---|
| 1,327,531 | A | | 1/1920 | Durham |
| 3,726,495 | A | | 4/1973 | Gawlick et al. |
| 3,863,354 | A | | 2/1975 | Karppinen |
| 3,877,383 | A | | 4/1975 | Flateau |
| 3,912,197 | A | | 10/1975 | McKown et al. |
| 4,313,272 | A | | 2/1982 | Matthews |
| 4,367,516 | A | | 1/1983 | Jacob |
| 4,777,754 | A | | 10/1988 | Reynolds |
| 4,777,883 | A | | 10/1988 | Chevich |
| 4,945,836 | A | | 8/1990 | Michaels |
| 5,067,406 | A | | 11/1991 | Olson et al. |
| 5,275,110 | A | | 1/1994 | Flatau |
| 5,365,669 | A | | 11/1994 | Rustick et al. |
| 5,454,168 | A | * | 10/1995 | Langner ..... 42/116 |
| 5,488,795 | A | | 2/1996 | Sweat |
| 5,515,787 | A | | 5/1996 | Middleton |
| 5,685,106 | A | * | 11/1997 | Shoham ..... 42/116 |
| 5,787,631 | A | | 8/1998 | Kendall |
| 5,808,226 | A | | 9/1998 | Allen et al. |
| 6,061,918 | A | | 5/2000 | Schnell |
| 6,146,141 | A | | 11/2000 | Schumannn |
| 6,151,788 | A | | 11/2000 | Cox et al. |
| D447,208 | S | | 8/2001 | Benini |
| 6,360,667 | B1 | | 3/2002 | Nisimura |
| 6,389,730 | B1 | | 5/2002 | Millard |

(Continued)

*Primary Examiner* — J. Woodrow Eldred
(74) *Attorney, Agent, or Firm* — Richard C. Litman

(57) ABSTRACT

The boresight laser aiming system for firearms provides a laser aiming beam through the mechanical action (20), chamber, and barrel (36) of the operable firearm (10) and through a specially configured live rimfire cartridge within the chamber, enabling a marksman to place the laser upon the target and fire the weapon simultaneously. The laser device (12) may be installed concentrically with a light passage through the bolt (22), hammer, or other mechanism of the firearm, or may be offset with the light path guided by one or more reflective mirrors, prisms, etc. The firearm may comprise a rifle (10), semiautomatic pistol, revolver, etc. The live cartridge has concentric inner and outer tubes defining a toroidal explosive charge-containing chamber therebetween and a light passage through the innermost tube, and a bullet having a passage therethrough allowing light to pass through the live cartridge assembly when placed in the firearm chamber.

17 Claims, 7 Drawing Sheets

U.S. PATENT DOCUMENTS 6,397,509 B1 6/2002 Langner
6,499,247 B1 * 12/2002 Peterson ..... 42/116
6,606,797 B1 8/2003 Gandy
6,622,414 B1 9/2003 Oliver et al.
6,631,580 B2 10/2003 Iafrate et al.
6,742,299 B2 6/2004 Strand
6,793,364 B2 9/2004 Cramer et al.
6,966,775 B1 11/2005 Kendir et al.
2001/0042335 A1 11/2001 Strand

* cited by examiner

BORESIGHT LASER AIMING SYSTEM FOR FIREARMS

TECHNICAL FIELD

The present invention relates generally to firearms and ammunition for firearms. More specifically, the present invention relates to a boresight laser aiming system for firearms in which the operable firearm (rifle, pistol, etc.) has an aiming sight passage formed concentrically through its action or firing mechanism and a laser aiming device permanently installed to pass an aiming beam therethrough and through the barrel and a rimfire cartridge having a laser sighting passage formed therein to provide an accurate aiming reference for the marksman.

BACKGROUND ART

Various forms of aiming systems and devices have been developed for firearms in the past, from simple open sights to more complex telescopic and electronic aiming devices and systems. The development of the laser has led to additional improvements in aiming devices for firearms due to the coherent light beam emitted by the laser, and its lack of scatter. As a result, various laser aiming devices for firearms have been developed in the past. Most such devices are configured for installation upon the exterior of the firearm, where the laser light aiming path is axially offset from the path of the firearm projectile (bullet) through the barrel of the firearm. Such an externally installed laser aiming device allows the firearm to remain operable, i.e., to remain capable of firing a bullet or projectile.

A number of devices have been developed using a different principle of laser aiming in which a laser emitting device is installed concentrically within a container emulating the configuration of a firearm cartridge, with the laser emitting device then being removably installed within the firing chamber of the firearm. The device transmits a laser beam of light concentrically through the barrel of the firearm when activated. The problem with this class of device is that it is not a true firearm aiming device as the firearm is not operable, i.e., it cannot be used to fire a round when such a laser device is installed therein, taking the place of a live cartridge.

Thus, a boresight laser aiming system for firearms solving the aforementioned problems is desired.

DISCLOSURE OF INVENTION

The boresight laser aiming system for firearms includes a specially configured firearm (rifle, pistol, etc.) having a laser emitting device installed therein. The firearm has a laser light passage formed through the firing action thereof (bolt, hammer, etc. and associated mechanism) concentric with the interior of the barrel. The firearm uses specially configured rimfire cartridges. The cartridges have a shell formed of concentric cylindrical inner and outer walls defining a toroidal explosive containment volume having a light passage formed concentrically therethrough. The bullet used with the cartridge also includes a concentric light passage therethrough. When the above-described cartridge is placed in the firing chamber of the operable firearm, the laser aiming device in the firearm can transmit a laser aiming beam concentrically through the action of the firearm, the live round in the chamber, and down the barrel, thus enabling the marksman to place the light emitted by the laser directly upon the target and to fire the live weapon and round as desired.

The firearm may comprise a rifle, semiautomatic pistol, revolver, or other firearm configuration. The laser may be installed coaxially directly behind the firing mechanism or action of the firearm, or may be axially offset and transmit its light through the action and barrel of the weapon by means of one or more reflective mirrors, prisms, or the like. The live cartridge may be configured to be compatible with any practicable laser boresight weapon. The cartridge may include a completely open axial light passage, or the passage may include one or more optically transparent windows in order to prevent the flow of explosive gas through the shell and/or bullet after firing. The laser may transmit optically visible light, or may transmit in the infrared or other light range invisible to the unaided eye.

These and other features of the present invention will become readily apparent upon further review of the following specification and drawings.

BRIEF DESCRIPTION OF THE DRAWINGS

Similar reference characters denote corresponding features consistently throughout the attached drawings.

BEST MODES FOR CARRYING OUT THE INVENTION

The present invention relates to a boresight laser aiming system for firearms in which a laser device is permanently installed within the operable firearm at a location generally behind the action. The action has a sighting passage therethrough aligned coaxially with the bore of the barrel of the firearm. The system includes a specially configured live rimfire cartridge having a sighting passage formed concentrically therethrough, which is aligned with the sighting passage of the firearm in use.

Figure 1:
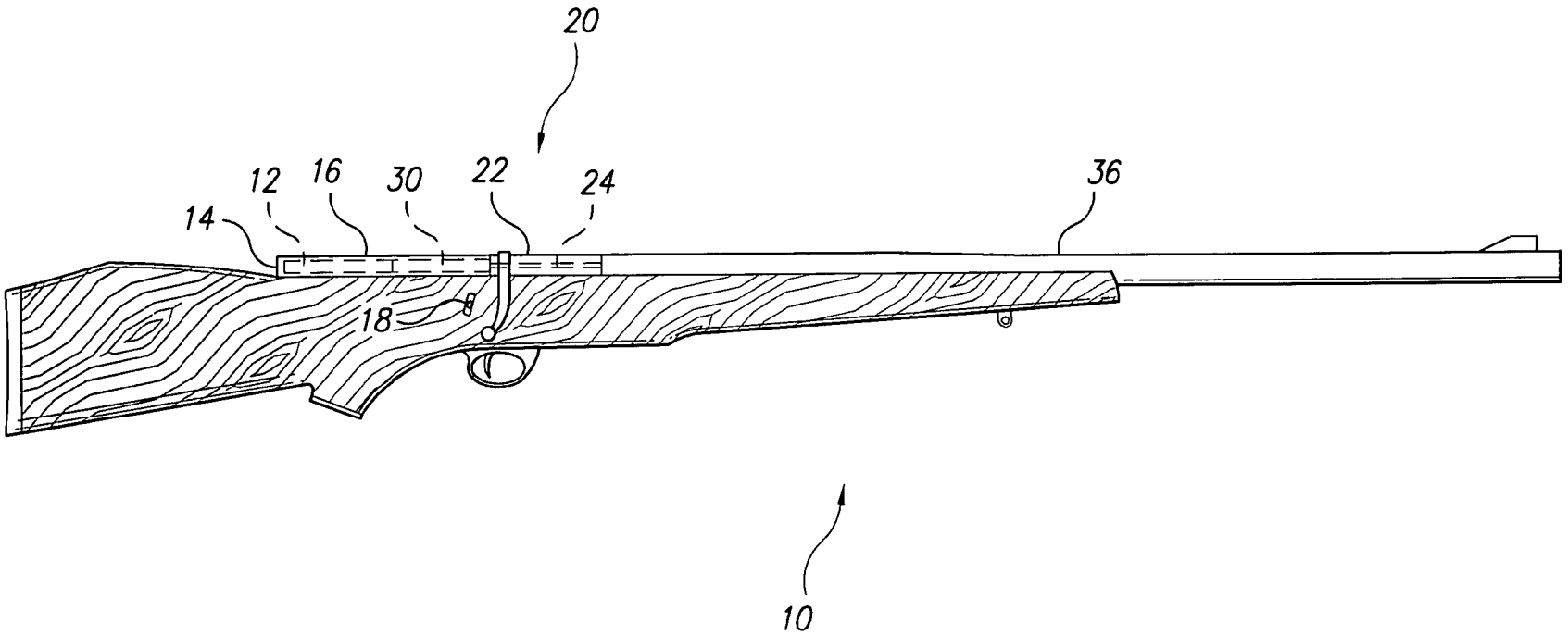
FIG. 1 is a right side elevation view of a first embodiment of a boresight laser aiming system for firearms according to the present invention in which the laser aiming device is in coaxial alignment with the rifle bore.
Figure 2:
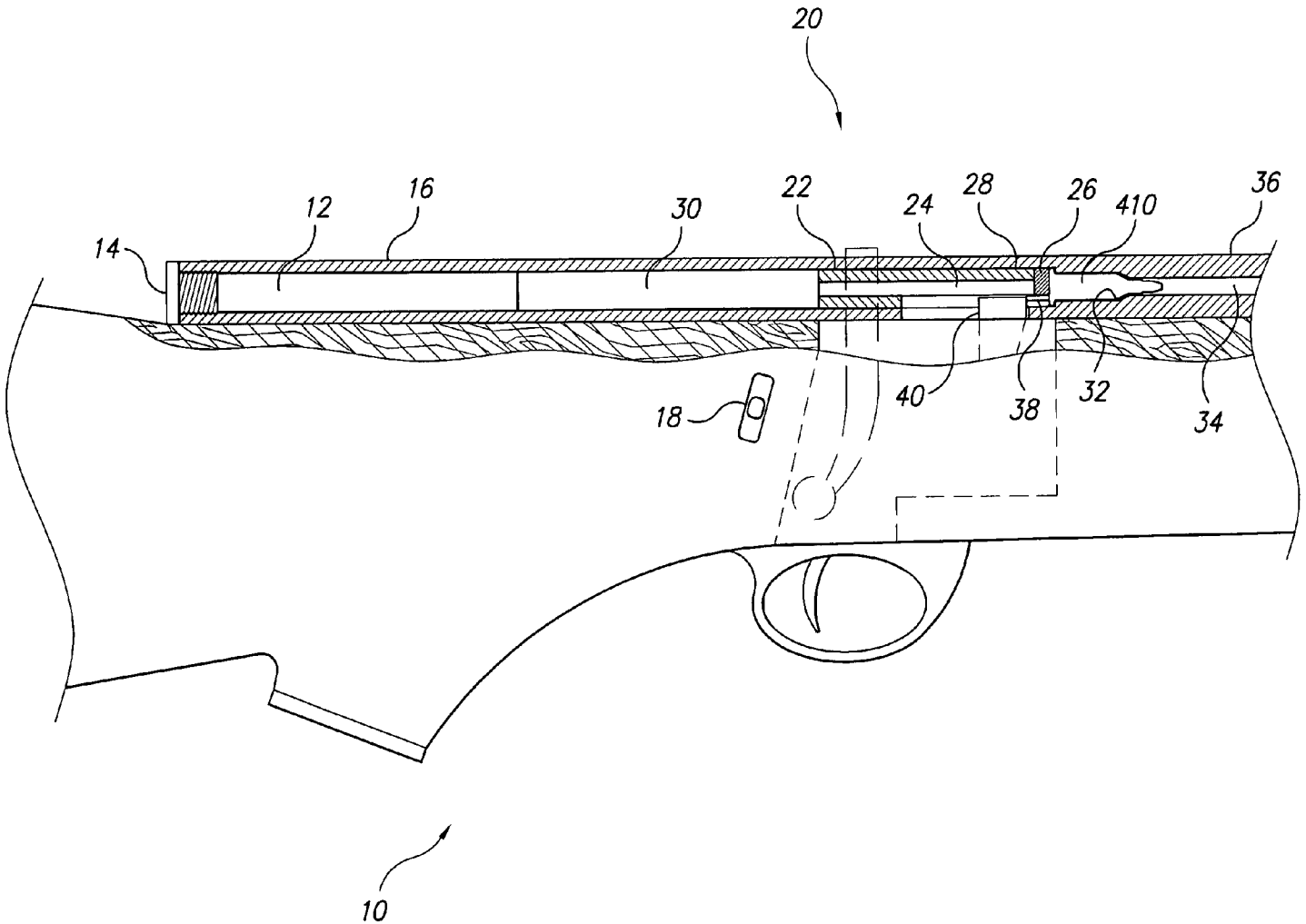
FIG. 2 is a partial right side elevation view in partial section of the boresight laser aiming system of the rifle of FIG. 1, showing further details thereof.

FIGS. 1 and 2 illustrate a first embodiment of the present system, comprising a bolt-action rifle 10 incorporating a laser device 12 permanently installed therewith. The laser device 12 is conventional, other than its installation within the operable rifle 10 or other firearm, and may include a source of electrical power (batteries, etc.) therewith. The batteries, recharging port, etc. may be accessed through a removable or openable cap or plug 14 providing access to the laser and battery housing 16 of the firearm. A switch 18 (momentary contact, continuous, etc.) is preferably located at a convenient point on the stock or action of the rifle 10 and connected electrically to the laser device 12 by conventional wiring, enabling the marksman to selectively activate the laser device 12 for aiming.

The bolt action 20 is shown in cross section in the more detailed view of FIG. 2. The bolt 22 includes a light aiming passage 24 formed concentrically therethrough. The bolt 22 may optionally include an optically transparent window 26 at the forward or chamber end 28 thereof. Such a window 26 serves to prevent blowback of explosive gases through the specially formed hollow cartridge (discussed in detail further below) used with the boresight aiming system when the bolt-action rifle 10 is fired. While instantaneous explosive forces may reach thousands of pounds per square inch (kilograms per square meter) within the rifle chamber when the weapon is fired, the light aiming passage 24 and window 26 of the bolt 22 have cross-sectional areas somewhat less than about one one-hundredth of an inch (0.254 mm), depending upon the caliber of the rifle 10 and other factors. Thus, the explosive force against the window 26 is only on the order of several tens of pounds (kilograms), which is well within the acceptable range for an optically transparent window of suitable material and thickness.

The action 20 of the rifle 10 includes a tubular passage 30 behind the bolt 22 to provide for retraction of the bolt when ejecting an expended shell and/or inserting a new round in the chamber, with the laser device 12 being permanently installed in the extension housing 16 disposed concentrically behind the bolt 22. Thus, the laser device 12 is aligned concentrically with the bolt 22 and its light aiming passage 24, as well as being aligned concentrically with the chamber 32 and bore 34 of the rifle barrel 36.

The operable rifle 10 and specially formed live cartridge used therewith utilize the rimfire principle, i.e., the firing pin 38 is radially offset from the center of the bolt 22 in order to provide for the concentric light aiming passage 24 formed through the bolt 22. The remainder of the action 20 is shown generally, with a hammer 40 operating through a slot in the bolt 22 and selectively striking the firing pin 38 when the trigger of the weapon is pulled. Additional conventional components of the bolt-action mechanism 20 have been omitted from the drawings for clarity.

Figure 3:
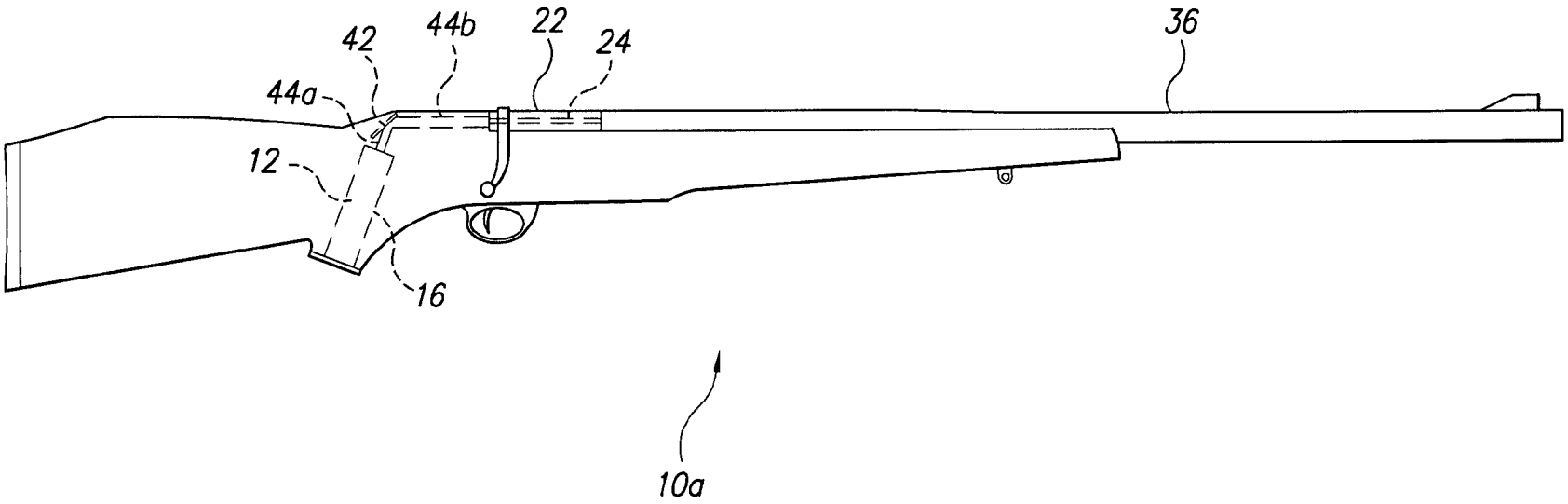
FIG. 3 is a right side elevation view of a second embodiment of the boresight laser aiming system for firearms according to the present invention in which the laser aiming device is axially offset from the rifle bore.

FIG. 3 is a general right side elevation view of another operable bolt-action rifle 10*a* incorporating the boresight laser aiming system. The rifle 10*a* incorporates most of the componentry of the rifle 10 of FIGS. 1 and 2, including conventional componentry, such as the barrel 36, bolt-action mechanism, etc. The rifle 10*a* of FIG. 3 also incorporates essentially the same bolt 22 with its axial light aiming passage 24 disposed concentrically with the chamber and bore of the barrel of the rifle 10*a*, as in the case of the rifle 10 of FIGS. 1 and 2. However, the laser device 12 of the rifle 10*a* is axially offset from the alignment of the light aiming passage 24 through the bolt 22 and remainder of the bolt action, as can be seen from the broken line showing of the laser device and battery housing 16*a* in FIG. 3. In this embodiment, the housing 16*a* for the laser device is axially displaced into the handgrip portion of the stock, rather than being installed directly behind the bolt and its action, as in the rifle 10 of FIGS. 1 and 2. Accordingly, a reflective element 42 (e.g., mirror, prism, etc.) is installed within the rifle stock in line with the initial light transmission path 44*a* from the laser device and the reflected path 44*b*, which is aligned concentrically with the light passage 24 through the bolt 22 and remainder of the bolt action. In this manner, the laser device may be installed in any practicable location within the firearm.

Figure 4:
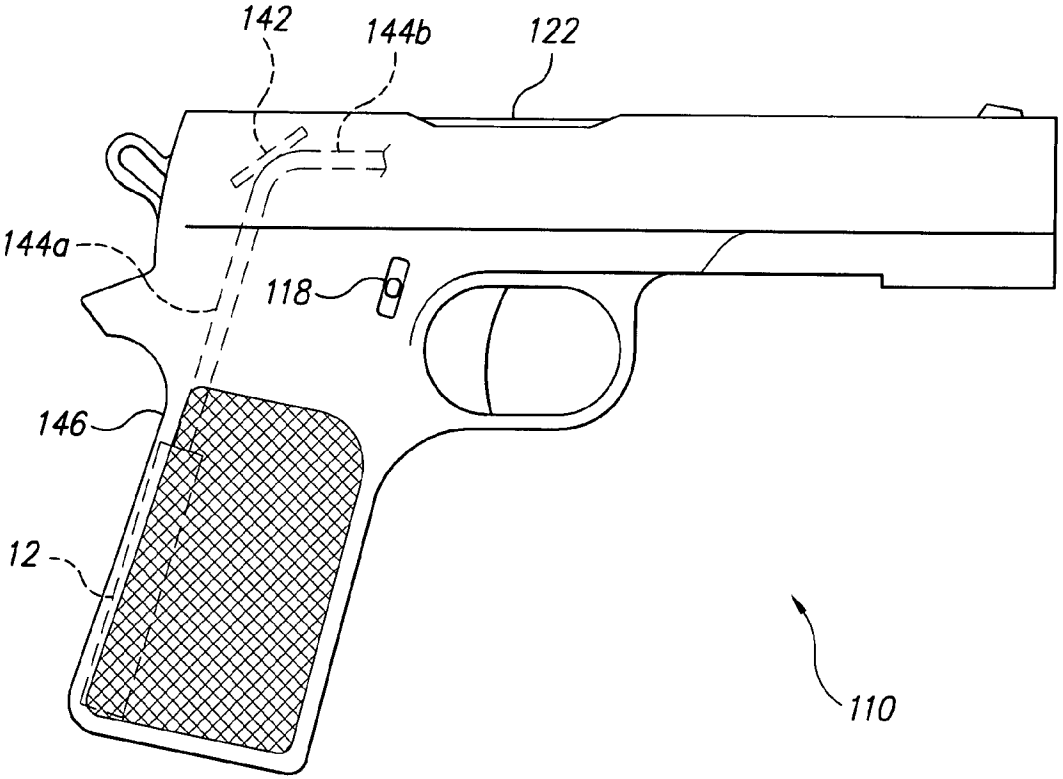
FIG. 4 is a right side elevation view of an exemplary semiautomatic pistol incorporating the boresight laser aiming system for firearms of the present invention.

FIG. 4 of the drawings provides a general right side elevation view of another embodiment of the boresight laser aiming system in which a laser device is installed within a specially configured operable semiautomatic pistol 110. The pistol 110 may incorporate a conventional firing mechanism action, with the exception being the bolt or slide 122. Rather than being formed as a solid unit, the bolt or slide of the pistol 110 incorporates a light passage therethrough in the same manner as that shown for the light passage 24 through the rifle bolt 22 of the rifles 10 and 10*a* of FIGS. 1 through 3. However, rather than placing the laser device 12 in concentric alignment with the light passage of the bolt or slide 122 of the pistol 110 and its conventional chamber and barrel, the laser device 12 is axially offset and installed within the handgrip portion 146 of the operable weapon 110 to provide a compact installation. The handgrip portion 146 of the semiautomatic pistol 110 is conventionally used for the removable installation of a magazine or clip therein to supply ammunition to the weapon, but there is sufficient volume within the handgrip 146 for the inclusion of a small, but bright, laser device 12 therein as well, as shown in broken lines in FIG. 4. A switch 118 may be installed at any convenient location upon the pistol 110 to control the laser device 12. A reflective element 142 (e.g., mirror, prism, etc.) is installed above the handgrip 146 in line with the initial light transmission path 144*a* from the laser device, and with the reflected path 144*b*, which is aligned concentrically with the light passage through the bolt or slide 122 and remainder of the action.

Figure 5:
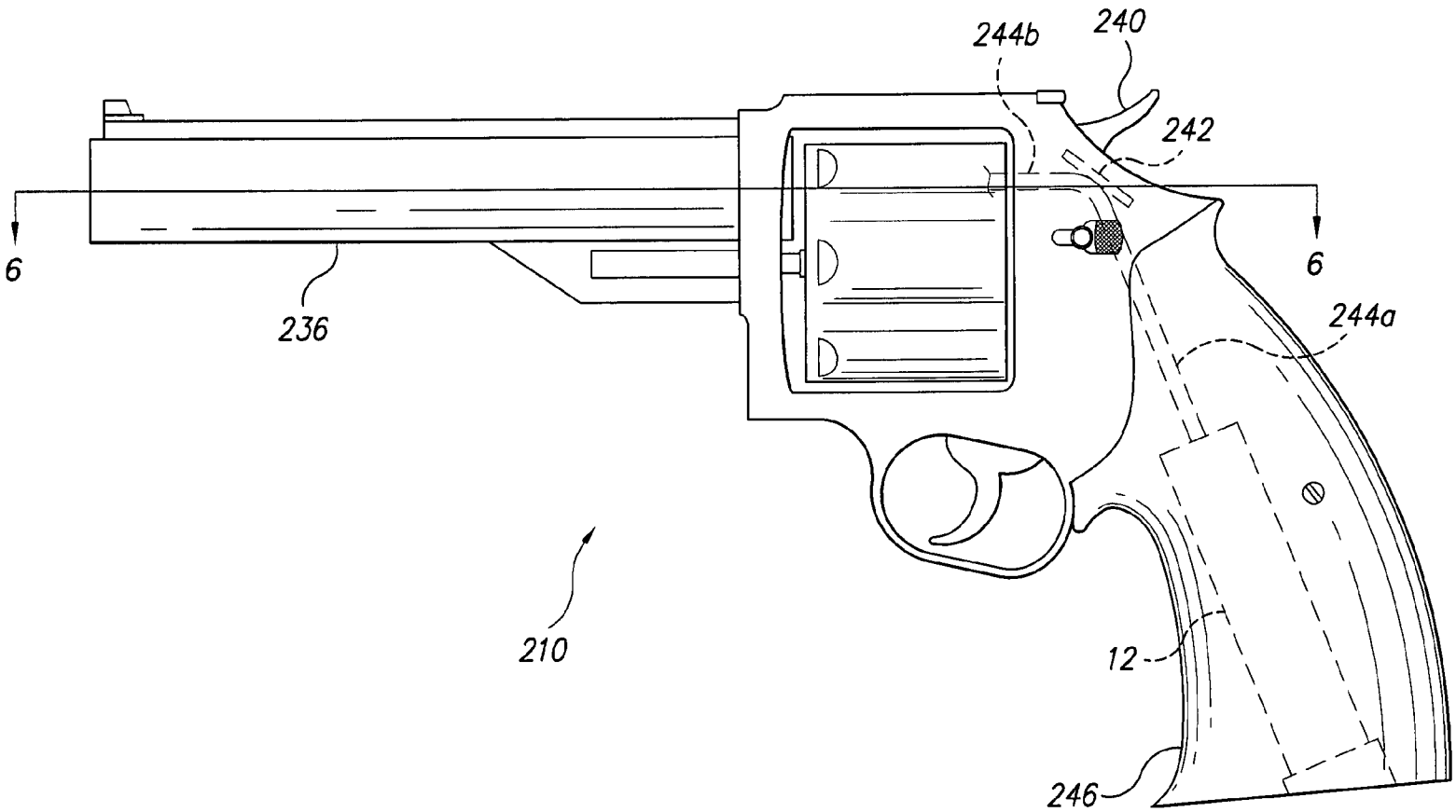
FIG. 5 is a left side elevation view of an exemplary revolver incorporating the boresight laser aiming system for firearms of the present invention.
Figure 6:
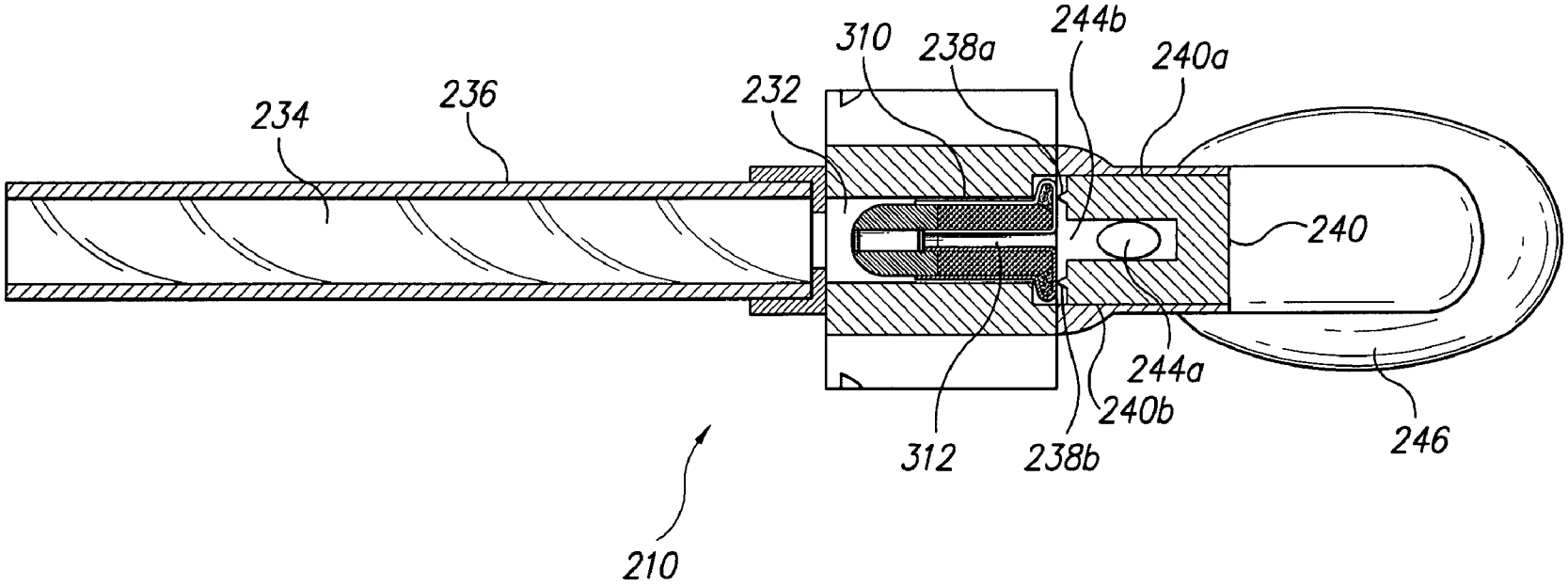
FIG. 6 is a partial section view along lines 6-6 of FIG. 5.

FIGS. 5 and 6 respectively provide a left side elevation view and a top plan view in section for a revolver 210 incorporating the laser aiming system of the present invention. The basic principle of the boresight laser aiming system of the revolver 210 is the same as that of the rifle 10*a* of FIG. 3 and semiautomatic pistol 110 of FIG. 4, i.e., a laser device 12 is located within the handgrip 246 of the pistol 210, with a reflective element 242 installed to reflect the initial light path or beam 244*a* to a path 244*b* that is concentric with the chamber 232 (shown in FIG. 6) and bore 234 (also shown in FIG. 6) of the barrel 236. However, rather than a bolt and firing pin acting directly upon the back or base of the cartridge, the revolver 210 utilizes a pivotally mounted hammer 240, shown most clearly in section in FIG. 6 of the drawings. The hammer 240 is specially configured to have a bifurcated configuration with laterally opposed elements 240*a* and 240*b* defining a portion of the chamber and barrel bore concentric light passage 244*b* therebetween. At least one of the two hammer elements 240*a*, 240*b* includes a firing pin extending forwardly therefrom, with there preferably being two such firing pins 238*a*, 238*b* extending respectively from the two hammer elements 240*a*, 240*b*. This aligns the firing pin(s) with the periphery or rim of the live rimfire cartridge 310 shown in the chamber 232 and in further detail in FIG. 7 of the drawings in order to allow the aiming light transmitted by the laser 12 to travel along the first light path 244*a*, reflect from the mirror or reflective element 242, and travel along the second light path 244*b* between the hammer elements 240*a*, 240*b*, through the light aiming passage 312 of the rimfire cartridge 310 and out the bore 234 of the barrel 236 to facilitate aiming the operable revolver 210.

Figure 7:
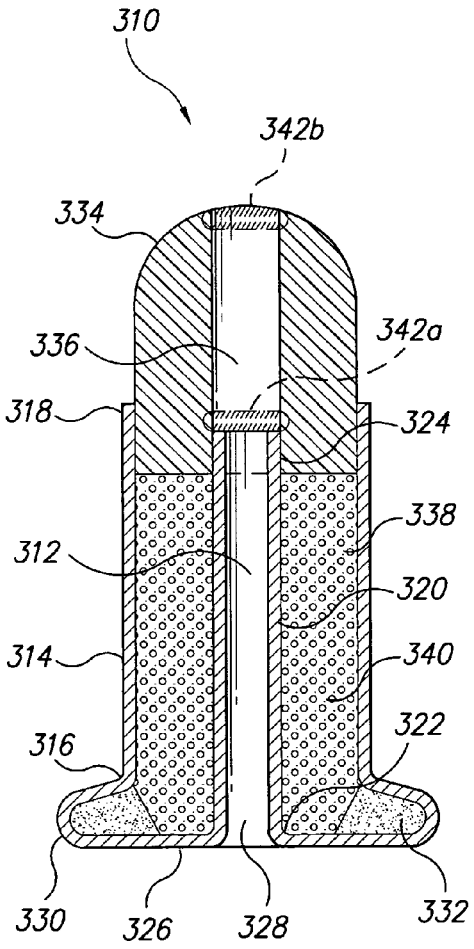
FIG. 7 is a sectional elevation view of an exemplary hollow core rimfire cartridge of a boresight laser aiming system for firearms according to the present invention.
Figure 8:
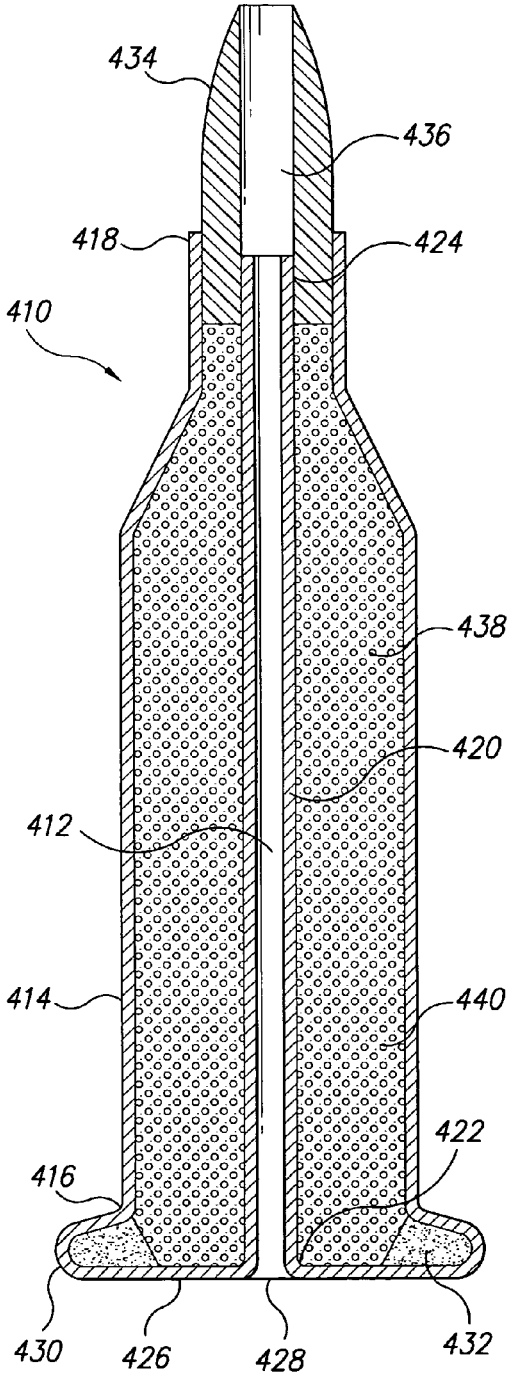
FIG. 8 is a sectional elevation view of another exemplary hollow core rimfire cartridge of a boresight laser aiming system according to the present invention.

FIG. 7 provides a sectional elevation view of a pistol type cartridge 310 having a concentrically disposed light aiming passage 312 therethrough, with FIG. 8 being a sectional elevation view of a necked down, Magnum-type cartridge 410 for use in compatibly configured firearms, generally rifles or more powerful weapons. The cartridge 310 comprises a generally tubular outer shell 314 having a rearward end 316 and opposite forward end 318. A generally tubular inner shell 320 is disposed concentrically within the outer shell 314. The inner shell has opposed rearward and forward ends 322 and 324. The rearward ends 316 and 322 of the outer and inner shells 314 and 320 are closed by a toroidal base 326 having a concentric light aiming passage 328 formed therethrough at its juncture with the rearward end 322 of the inner shell 320 and coaxially aligned therewith, and a periphery or rim 330 joining the rearward end 316 of the outer shell.

The outwardly extending flanged rim 330 of the base 326 contains a peripheral rimfire primer charge 332 therein, compatible with the rimfire firing pins provided in the various operable firearm embodiments disclosed herein. The forward ends 318 and 324 of the outer and inner shells are closed by a bullet 334 removably secured thereto, with the bullet 334 having an axial light aiming passage 336 formed completely therethrough and aligned concentrically with the light aiming passage 312 of the inner shell 320 and light aiming passage 328 of the base 326. The inner shell 320, base 326, and bullet 334 define a closed explosive charge container volume 338 having a toroidal cross section, containing the explosive charge or gunpowder 340 conventionally used to produce the explosive power for firing a bullet or projectile from a weapon.

It will be seen that the light aiming passage 328 of the base 326, passage 312 of the inner shell 320, and passage 336 of the bullet 334 provide a completely open passage extending through the length of the cartridge 310. While the explosive charge volume 338 within the outer and inner shells 314 and 320 is initially closed, it will be seen that this volume 338 opens immediately once the explosive force has separated the bullet 334 from the two shells 314 and 320. Accordingly, some of the explosive gases may tend to flow through the central light aiming passage 336 of the bullet 334. This may be precluded by optionally providing an optically transparent window across the light aiming passage 336 of the bullet 334, e.g., a rearwardly disposed window 342*a* and/or forwardly disposed window 342*b*. The window or windows 342*a* and/or 342*b* are shown in broken lines in FIG. 7 to indicate their optional installation, which serve essentially the same purpose as the window 26 provided in the forward or chamber end 28 of the bolt 22 of the firearm 10 or 10*a* of FIGS. 1 through 3, i.e., to prevent the explosive gases from dissipating their force by flowing back through the light aiming passage (s).

FIG. 8 of the drawings provides an elevation view in section of a boresight aiming system live cartridge 410 having a necked down forward portion, i.e., a Magnum configuration for use in compatibly configured firearms. The cartridge 410 of FIG. 8 is configured essentially like the cartridge 310 of FIG. 7, i.e., having an outer shell 414 with rearward and forward ends 416 and 418, a concentric inner shell 420 having rearward and forward ends 422 and 424 and defining an axial light aiming passage 412 therethrough, a toroidal base end 426 with a light aiming passage 428 therethrough, and a rim 430 enclosing a peripheral or rimfire primer charge 432, a bullet 434 removably secured in the upper ends of the two shells 414 and 420, the bullet having an axial light aiming passage 436 therethrough, the closed space defined by the inner and outer shells 414 and 420, the base 426, and the bullet 434 defining a closed explosive charge container volume 438 having a toroidal cross section containing the explosive charge or gunpowder 440 conventionally used to produce the explosive power for firing a bullet or projectile from a weapon. The bullet 434 may contain explosive force containing windows similar to the optionally shown windows 342*a*, 342*b* of the cartridge 310 of FIG. 7. The primary difference between the two live cartridges 310 and 410 is the much greater interior volume 438 of the cartridge 410 relative to the diameter or caliber of the bullet 434 in order contain a relatively greater quantity of explosive charge to produce higher muzzle velocities and greater impact force from the bullet 434.

In conclusion, the boresight laser aiming system for firearms greatly facilitates the aiming of an operable weapon, particularly in rapid fire situations and at relatively close ranges. The aiming system is primarily intended for use at relatively close ranges, where ballistic effects, windage, etc., do not appreciably change the impact point of a bullet from its idealized straight line trajectory as would be indicated by the straight aiming line produced by a boresight laser device. The aiming system allows a marksman to view the visible dot of light produced by the laser device and manipulate the operable weapon to place the dot directly upon the target, and then fire the same weapon as equipped with the boresight aiming device. The laser device may transmit a light beam visible to the unaided eye, or may alternatively be selected to produce an aiming beam at a frequency invisible to the naked eye, e.g., in the infrared range, whereupon the marksman may use infrared optical viewing means to sight on the target without the target personnel becoming aware of the situation, as would occur using visible aiming light frequencies. Accordingly, the present boresight laser aiming system enables the marksman to aim directly down the bore of the operating weapon and fire that same weapon at the target while using live ammunition with the boresight aiming system. The system may be employed by virtually anyone having need to use a firearm in a variety of situations, but will prove invaluable in law enforcement and military environments, where situations requiring rapid fire response at close quarters often occur.

It is to be understood that the present invention is not limited to the embodiment(s) described above, but encompasses any and all embodiments within the scope of the following claims.

The invention claimed is:

1. A boresight laser aiming system for a firearm, comprising:

an operational firearm having an action and a barrel defining a bore through the barrel, the action defining a light aiming passage therethrough concentric with the bore of the barrel;

a laser device disposed within the firearm, the laser selectively transmitting a laser light aiming beam through the light aiming passage of the action and through the bore of the barrel; and a live rimfire cartridge having a concentrically disposed light aiming passage therethrough, the cartridge being removably inserted into the action, the light aiming passages of the action and the cartridge being aligned with the laser beam and the barrel bore.

2. The boresight laser aiming system for a firearm according to claim 1, wherein the laser device is aligned concentrically with the light aiming passage of the action and the bore of the barrel.

3. The boresight laser aiming system for a firearm according to claim 1, wherein the laser device is axially offset from the light aiming passage of the action and the bore of the barrel, the system further comprising at least one reflective element is disposed between the laser device and the light aiming passage of the action, the reflective element being aligned to reflect light from the laser device through the light aiming passage of the action and the bore of the barrel.

4. The boresight laser aiming system for a firearm according to claim 1 wherein the firearm action is selected from the group consisting of a bolt action having a bolt with an aiming passage disposed concentrically therethrough, and a hammer action having a hammer with a light aiming passage formed therethrough.

5. The boresight laser aiming system for a firearm according to claim 4, the bolt of the bolt action having a chamber end and an optically transparent window disposed in the chamber end of the bolt.

6. The boresight laser aiming system for a firearm according to claim 1 wherein the live rimfire cartridge further comprises:

a generally tubular outer shell having a rearward end and a forward end;

a generally tubular inner shell disposed concentrically with the outer shell, the inner shell having a rearward end and a forward end;

a base disposed across the rearward end of the outer shell and inner shell, the base containing a generally peripheral rimfire primer charge therein, the base further defining a light aiming passage disposed concentrically therethrough and coaxially disposed with the inner shell; and a bullet secured to the forward end of the outer shell and inner shell, the bullet defining a light aiming passage therethrough concentric with the light aiming passages of the inner shell and rearwardly disposed base, the outer shell, inner shell, base, and bullet defining a toroidal explosive charge container volume therein.

7. The boresight laser aiming system for a firearm according to claim 6, wherein the bullet further includes at least one optically transparent window disposed within the light aiming passage thereof.

8. A boresight laser aiming system for a firearm, comprising:

an operational firearm having a an action and a barrel having a bore through the barrel, the action defining a light aiming passage therethrough concentric with the bore of the barrel; and a laser device disposed within the firearm generally rearward of the action, the laser device selectively transmitting a laser light aiming beam through the light aiming passage of the action and through the bore of the barrel.

9. The boresight laser aiming system for a firearm according to claim 8, wherein the laser device is aligned concentrically with the light aiming passage of the action and the bore of the barrel.

10. The boresight laser aiming system for a firearm according to claim 8, wherein the laser device is axially offset from the light aiming passage of the action and the bore of the barrel, the system further comprising at least one reflective element disposed between the laser device and the light aiming passage of the action, the reflective element being aligned to reflect light from the laser device through the light aiming passage of the action and the bore of the barrel.

11. The boresight laser aiming system for a firearm according to claim 8 wherein the firearm action is selected from the group consisting of a bolt action having a bolt with an aiming passage disposed concentrically therethrough, and a hammer action having a hammer with a light aiming passage formed therethrough.

12. The boresight laser aiming system for a firearm according to claim 11, the bolt of the bolt action having a chamber end and an optically transparent window disposed in the chamber end of the bolt.

13. The boresight laser aiming system for a firearm according to claim 8, further including a live rimfire cartridge having a concentrically disposed light aiming passage therethrough.

14. The boresight laser aiming system for a firearm according to claim 13 wherein the rimfire cartridge further comprises:

a generally tubular outer shell having a rearward end and a forward end;

a generally tubular inner shell disposed concentrically with the outer shell, the inner shell having a rearward end and a forward end;

a base disposed across the rearward end of the outer shell and inner shell, the base containing a generally peripheral rimfire primer charge therein, the base defining a light aiming passage disposed concentrically therethrough and coaxially disposed with the inner shell; and a bullet secured to the forward end of the outer shell and inner shell, the bullet defining a light aiming passage therethrough and concentric with the light aiming passages of the inner shell and rearwardly disposed base, the outer shell, inner shell, base, and bullet defining a toroidal explosive charge container volume therein.

15. The boresight laser aiming system for a firearm according to claim 14, wherein the bullet further includes at least one optically transparent window disposed within the light aiming passage thereof.

16. A rimfire firearm cartridge, comprising:

a generally tubular outer shell having a rearward end and a forward end;

a generally tubular inner shell disposed concentrically with the outer shell, the inner shell having a rearward end and a forward end;

a base disposed across the rearward end of the outer shell and inner shell, the base containing a generally peripheral rimfire primer charge therein, the base further defining a light aiming passage disposed concentrically therethrough coaxially disposed with the inner shell; and a bullet secured to the forward end of the outer shell and inner shell, the bullet defining a light aiming passage therethrough concentric with the light aiming passages of the inner shell and rearwardly disposed base, the outer shell, inner shell, base, and bullet defining a toroidal explosive charge container volume therein.

17. The rimfire firearm cartridge according to claim 16, wherein the bullet further includes at least one optically transparent window disposed within the light aiming passage thereof.

* * * * *